US006298521B1

(12) United States Patent
Butterfield

(10) Patent No.: US 6,298,521 B1
(45) Date of Patent: Oct. 9, 2001

(54) DOOR KNOB SANITIZING DEVICE

(76) Inventor: Gary Butterfield, 5825 Oakhurst Dr., Seminole, FL (US) 33772

( * ) Notice: Subject to any disclaimer, the term of this patent is extended or adjusted under 35 U.S.C. 154(b) by 0 days.

(21) Appl. No.: 09/419,885

(22) Filed: Oct. 18, 1999

(51) Int. Cl.[7] ..... E05B 1/00

(52) U.S. Cl. ..... 16/412; 16/413; 16/904; 604/890.1

(58) Field of Search ..... 16/412, 413, 414, 16/116, 120, 904; 292/115; 604/265, 268, 890.1; 424/472, 473, 474, 404, 405; 239/57

(56) References Cited

U.S. PATENT DOCUMENTS

D. 288,714 * 3/1987 Wilson et al. ..... D23/150
D. 427,046 * 6/2000 Mannix ..... D8/322
D. 435,641 * 6/2000 Clement et al. ..... D23/366
1,491,780 * 4/1924 Abbott .
5,383,598 * 1/1995 Styles ..... 239/57
5,407,685 * 4/1995 Malchesky et al. ..... 424/449

* cited by examiner

*Primary Examiner*—Anthony Knight
*Assistant Examiner*—Martz Williams
(74) *Attorney, Agent, or Firm*—Harold D. Shall

(57) ABSTRACT

A housing containing a sublimable disinfectant with the housing having an adhesive on the rear end for securing the housing to the backing plate behind a door knob. The housing has circumferential slots in the front end thereof so that the sublimed disinfectant vapors may reach the door knob. The housing is split in half so that it can be fit around the door knob shaft behind the knob.

3 Claims, 2 Drawing Sheets

DOOR KNOB SANITIZING DEVICE

FIELD OF THE INVENTION

This invention relates to sanitizing devices generally and more particularly to devices for supplying an atmosphere surrounding a door knob which coats the surface of the knob and thereby reduces microbiological activity on the surface of the door knob.

DESCRIPTION OF PRIOR ART

The usual method of reducing microbiological activity on the surface of a door knob is to spray or wipe the same with a strong disinfectant. This presents a great problem in that it is inconvenient to do this on a consistent basis, and a periodic wipe or spray is not sufficient. Other devices such as seen in U.S. Pat. No. 4,856,140, provide a cover for the knob. The disadvantages of this are that the treated cover can readily slip on the knob when the latter is grasped and turned and there is no storage capacity for a supply of disinfectant. To remedy the slipping this above patent provides slots in the cover so that the fingers may grasp the underlying knob. The slots, however, appear to be disadvantageous because they are locations which can result in the cover tearing or being twisted out or shape and the fingers extending through the cover to contact the underlying knob which may not be adequately sanitized.

SUMMARY OF THE INVENTION

The above problems and difficulties are overcome by the present invention which supplies an atmosphere surrounding the graspable surface of the door knob by having a supply, adjacent to the graspable knob, of anti-microbiological material, which materials is a disinfectant material which sublimes to envelope the surface of the knob and thereby provide protection to the user of the knob by microbiological action. The material is a fairly thick gel which is in a holding device which is mounted adjacent the knob.

DETAILED DESCRIPTION OF THE PREFERRED EMBODIMENT

Figure 1:
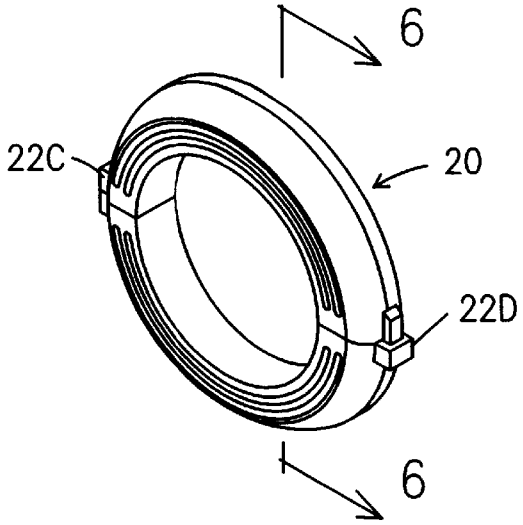
FIG. 1 is a front isometric view of the following device according to this invention.
Figure 6:
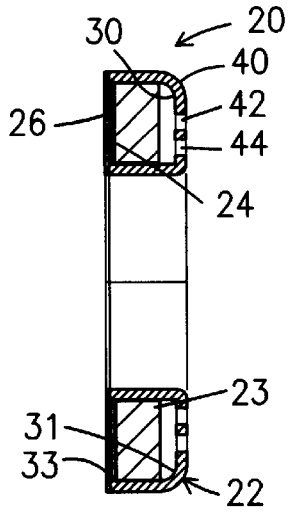
FIG. 6 is a sectional view taken along the lines 6—6 in FIG. 1.
Figure 2:
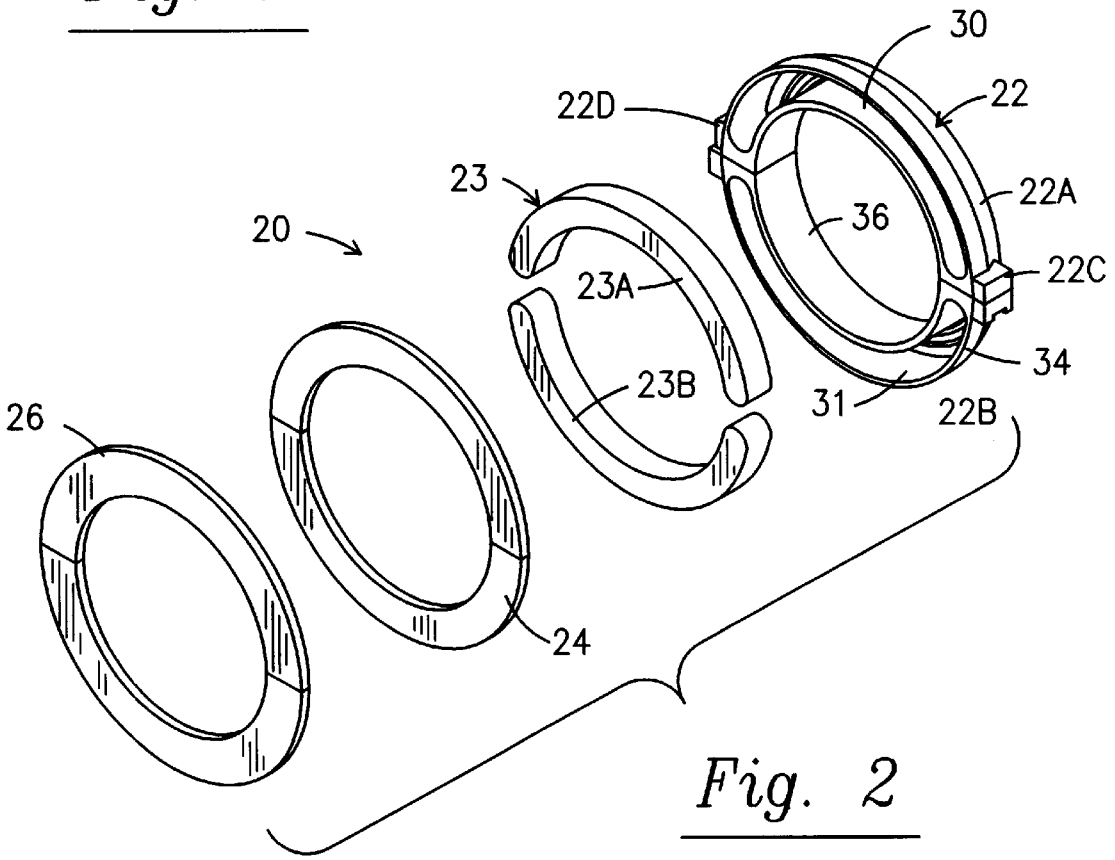
FIG. 2 is a rear isometric view of the device of FIG. 1 having the elements of the device in an exploded relationship.
Figure 4:
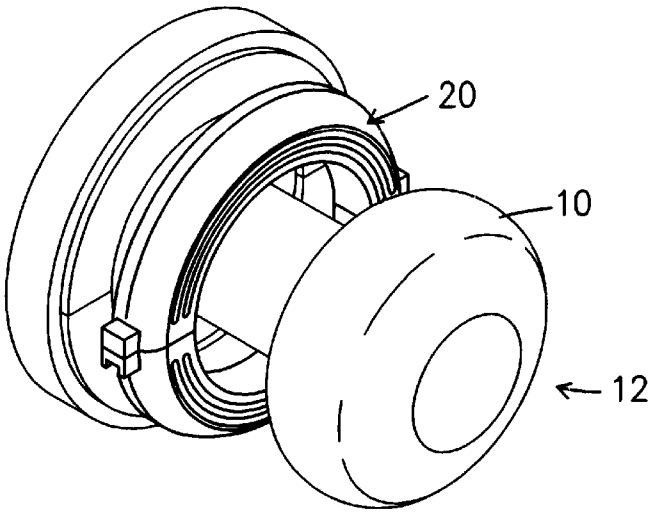
FIG. 4 is a view like FIG. 3 of a device which is almost fully mounted.
Figure 5:
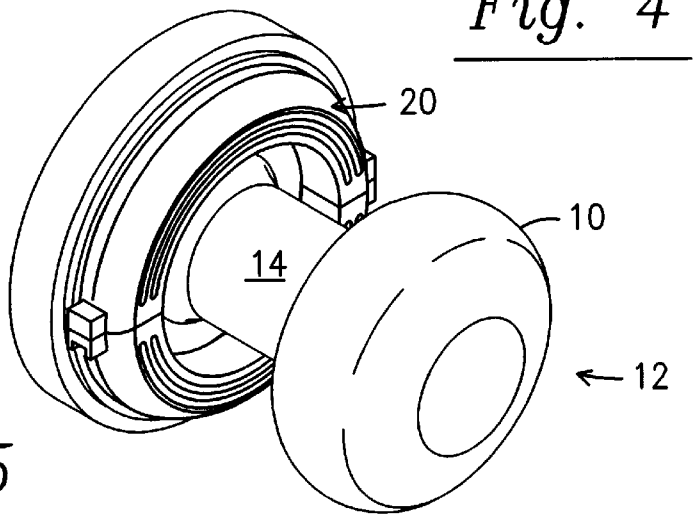
FIG. 5 is a view like FIG. 4 with the device fully mounted.
Figure 3:
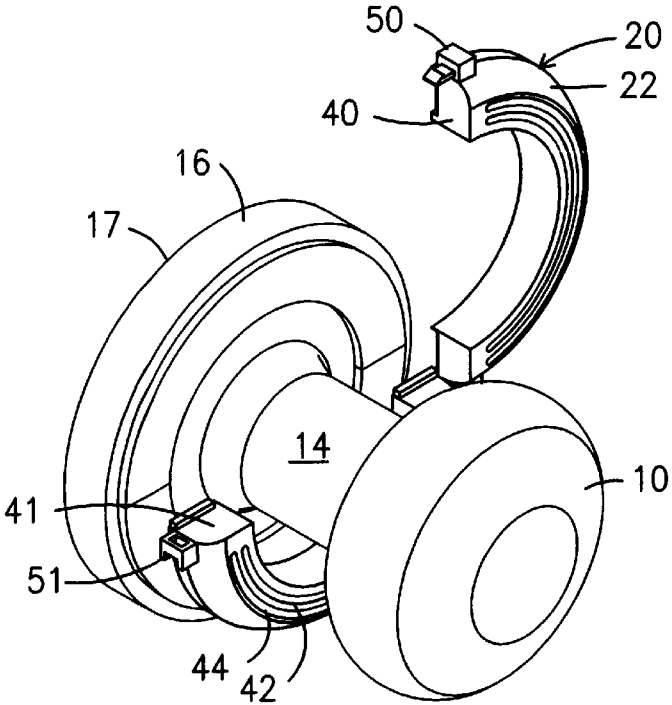
FIG. 3 is an isometric view of the of FIG. 1 about to be mounted adjacent a door knob.

Referring now to the drawings, and more particularly FIGS. 3, 4 and 5, the graspable knob portion 10, of a conventional door knob 12, is conventionally carried by for unitary rotation by a shaft 14, with the latter being rotatably mounted in a conventional latch for closing a door in a door jam. Since the latch and door may be of any configuration usable with a knob and shaft, such has not been shown. A conventional door knob plate 16 normally abuts the door on its back side 17 and is conventionally securely and non-rotatably mounted to the door and/or the remainder of the latch assembly.

Referring now to all the drawings a multi piece assembly of a holding device or carrier 20 for mounting the disinfectant materials is shown generally and includes a housing member 22 made of rigid plastic material and a split ring 23 of disinfectant material, more fully described hereinafter, a split washer, 24 of suitable rigid plastic material and a split washer 26 made of two sided adhesive tape. The housing member 22 is made of two semi-circular portions 22A and 22B hinged together by a hinge 22C, which allows the portions 22A and 22B to move to an open position, as seen in FIG. 3, wherein the ends of the semicircular portions opposite the hinge 22C to open and close to thereby allow the assembly 20 to be open as shown in FIG. 3 or closed, as seen in FIGS. 1, 4, 5 and 6. With the assembly open as seen in FIG. 3, the assembly can be placed around the shaft 14 and then closed as seen in FIGS. 4 and 5 in a surrounding relationship with the shaft 14, and as seen in FIG. 5, in an adhesively secured abutting relationship with the door knob plate 16. An interlocking arrangement shown generally at 22D is operative to secure the free ends of 40 and 41 of the assembly together.

The housing member 22 has a pair of semi-annular groves 30 and 31 therein, with the groove 30 in the member 22A and the groove 31 in the member 22B, which grooves are open at the side of housing member 22 facing the plate 16. The split ring 23 of disinfectant material is made of semi annular segments 23A and 23B which segments are received in the grooves 30 and 31, respectively. While the periphery of the segments 23A and 23B closely fit the periphery of the grooves they are spaced slightly forward of the rear 33 of the peripheral wall 34 of housing member 22.

The inner annular wall 36 of the housing 22 does not extend quite as far back as the rear of the peripheral wall 34 so that the periphery of the washer can snugly fit within the peripheral wall and abutting the inner wall 36 so that the split ring 23 and washer 24 can open and close with the housing member 22 and thus placed about the shaft 14. The locking member 22D can secure the free ends 40 and 41 together.

The two sided adhesive washer 26 is also split so that it can be opened to be placed about the shaft 14. This washer can preferably be prepared as a part of the assembly 20 with the ring 26 adheringly abutting the ring 24 and the split ends of the rings 24 and 26 aligned with the split ends of the member 22, and once placed about the shaft 14, the assembly 20 can be pushed back against the door knob plate 16 to thereby secure the former to the latter.

The front wall 40 of the housing member 22 has a plurality of semi annular grooves 42 and 44 therein extending axially therethrough to each form a passage from the grooves 30 and 31 directed to the area surrounding the shaft 14 and the knob 10.

The split ring of antibacterial material 23 is preferably made of a fairly solid material which is a sublimable disinfectant. Additionally, if desired, a sublimable deodorizer can be incorporated along with the disinfectant. A suitable antibacterial material can be made from a mixture of 95 percent ethyl alcohol and 5 percent water (v/v) (this is a standard commercially available mixture) to which is added approximately 1.5 to 2 percent (w/w) RHEOLATE (R), 5000 which is a thickening agent.

This mixture is then neutralized by a base to pH of 7 by a neutralizer as follows to give a viscosity of about 20,000 cps (RVT,Spindle #5,201 rpm)

| NEUTRALIZING AGENT (R)5000 | APPROX. WEIGHT RATIO OF BASS TO RHEOLATE |
|---|---|
| Trictharolamine (TEA) | 1.5/1 |
| Aminomethye Propanol (AMP) | 1/1 |
| NaOH, 10% solution | 4/1 |
| KOH, 10% solution | 4/1 |

The RHEOLATE (R) 5000 is available from RHEOX, Inc. of Highstown, N.J. and is a high molecular weight, water dispersable, carboxyarnyl copolymer, used as thickening and emulsifying agent in various formulation. The results, when used with the ethyl alcohol, is a thickened sublimable gel which can be formed into the split ring 23 in the assembly 20. When the assembly 20 is mounted on the plate 16 the alcohol will sublime and some of its vapors collect on the knob 10 and the shaft 14, so that when the knob is grasped the alcohol will act in a well renown manner so that there will be a substantial reduction in or elimination of active microbiological material on the knob or shaft to infect the user.

Other concentrations of alcohol (as low as a 65% solution of ethyl alcohol in water (v/v) have been found to be effective in killing bacteria.

While only a single embodiment of this invention has been shown and described, it is understood that modifications can be made therein without departing from the scope of this invention as defined by the following claims.

What is claimed is:

1. A device supplying a sanitizing vapor on and around a knob and supporting shaft of a door knob assembly with a shaft projecting from a backing plate comprising in combination, a) a housing member mountable about the shaft and having a front end facing the knob and a rear end facing the backing plate, 1) said member having an annular groove therein which groove is open to the rear end thereof, and a plurality of annular slots in the forward end thereof confluent with the annular groove, b) a sublimable substantially solid material disposed in said groove, c) holding means secured to said housing member and holding said sublimable material in said groove, and adhesive means for securing said holding means to a backing plate, d) said assembly being split into a plurality of circumferentially extending segments whereby the same may be positioned around the shaft and including means for connecting said segments into an annular configuration.

2. A device a sanitizing vapor around and on the knob and supporting shaft of a door knob assembly with a shaft projecting from a backing plate, comprising in combination, a) a multi piece assembly including, 1) a housing member having a rear and a forward end with the rear end facing the plate and being made of two semicircular portions and having hinge connecting adjacent ends of said portions, whereby said portions can move between an open and a closed position, and a latch means for securing the non-hinged ends of said portions for holding said portions in a secure annular configuration, 2) each of said portions having a semi annular groove therein open at the rear of said housing member and semi circular slots in the forward end of said member confluent with said semi annular groove, 3) a substantially solid and sublimable disinfectant material formed in two semicircles and disposed in said semi annular groove and operative to sublime disinfectant out of said circular slots, 4) a washer member abutting the rear end of said disinfectant material at the rear end of said assembly, and 5) adhesive means for securing the rear of said assembly to the backing plate.

3. A device according to claim 2 where said sublimable material is made of a 95% ethyl alcohol and 5% water mixture, by volume, combined with approximately 1½ to 0.2%, by weight, of a high molecular weight, water dispersable carboxyarnyl copolomer, and then neutralized with a base from a group consisting of triethanolamine, Aminomethyl Propanol, NaOH, and KOH.

* * * * *